US007108390B2

(12) United States Patent
Lawless

(10) Patent No.: US 7,108,390 B2
(45) Date of Patent: Sep. 19, 2006

(54) LIGHT GUIDE FOR PROJECTING WEAPONS AND HANDTOOLS

(76) Inventor: Albert J. Lawless, P.O. Box 3764, Boulder, CO (US) 80307

( * ) Notice: Subject to any disclaimer, the term of this patent is extended or adjusted under 35 U.S.C. 154(b) by 0 days.

(21) Appl. No.: 10/151,082

(22) Filed: May 17, 2002

(65) Prior Publication Data

US 2002/0172034 A1 Nov. 21, 2002

Related U.S. Application Data

(60) Provisional application No. 60/292,274, filed on May 17, 2001.

(51) Int. Cl.
*F41G 1/34* (2006.01)

(52) U.S. Cl. ..... 362/110; 362/190; 362/191; 362/109

(58) Field of Classification Search ..... 362/110, 362/109, 205, 202, 253, 190, 191, 396, 287
See application file for complete search history.

(56) References Cited

U.S. PATENT DOCUMENTS

| | | | | |
|---|---|---|---|---|
| 1,826,004 | A | 10/1931 | Key | |
| 2,209,524 | A | 7/1940 | Key | |
| 2,450,584 | A | 10/1948 | Dodge | 240/641 |
| 3,106,348 | A | 10/1963 | Robinson | |
| 4,697,226 | A | 9/1987 | Verdin | |
| 4,758,933 | A | 7/1988 | Winberg et al. | |
| 5,040,322 | A * | 8/1991 | Iturrey, Jr. | 42/103 |
| 5,046,277 | A * | 9/1991 | Sanders | 42/101 |
| 5,167,446 | A | 12/1992 | Haroutunian | |
| 5,177,309 | A * | 1/1993 | Willoughby et al. | 42/115 |
| 5,560,703 | A * | 10/1996 | Capps, III | 362/110 |
| 5,628,555 | A * | 5/1997 | Sharrah et al. | 362/114 |
| 5,743,623 | A * | 4/1998 | Kerr | 362/190 |
| 5,816,683 | A * | 10/1998 | Christiansen | 362/110 |
| 6,023,875 | A | 2/2000 | Fell et al. | |
| 6,438,888 | B1 * | 8/2002 | Lin et al. | 42/114 |

OTHER PUBLICATIONS

"Flashlight Mount," Gun World, p. 4, Feb. 2002.
Product literature; "Quik-2-See," ca 2002?.
Unknown catalog; p. 39, "Quik-2-See".

* cited by examiner

*Primary Examiner*—Sandra O'Shea
*Assistant Examiner*—Anabel Ton
(74) *Attorney, Agent, or Firm*—Connolly Bove Lodge & Hutz LLP

(57) ABSTRACT

A light source guide for attachment to a bottom of a grip of a handgun, a bottom of a firearm magazine, a hand tool or the like, used for resting on top of a portion of the light. The guide is adaptable for receipt on different sizes, shapes, types and lengths of light sources. The light source guide preferably includes a guide base having a upper surface and a first rail and a second rail extending downwardly and outwardly from opposite sides of a bottom surface of the guide base. The first and second rails and the bottom surface of the guide base are preferably adapted for rapid engagement to the top of a suitable light source. Also, the guide base can include at least one aiming wedge disposed between the upper surface of the guide base and the bottom of the implement to which it attaches. The aiming wedges are used for adjusting vertically the alignment of the flashlight beam relative to the line of sight of the handgun or hand tool so that they at a selected distance.

22 Claims, 6 Drawing Sheets

LIGHT GUIDE FOR PROJECTING WEAPONS AND HANDTOOLS

REFERENCE TO RELATED APPLICATIONS

This application is based on a provisional patent application filed on May 17, 2001 having Ser. No. 60/292,274 by the same inventor and having a title of "LIGHT GUIDE FOR TOOLS AND FIREARMS". A related application by the same inventor, AJL-1, based upon a provisional application also filed on May 17, 2001, U.S. Ser. No. 60/291,693, is directed to "ERGONOMIC FINGER GRIP ENHANCERS FOR MOUNTING ON FIREARMS, SPORTING IMPLEMENTS OR HAND TOOLS".

BACKGROUND OF THE INVENTION (A) Field of the Invention

This invention relates to a flashlight guide used with firearms, hand tools and the like and more particularly, but not by way of limitation, to a flashlight guide for mounting on the bottom of a handgun grip, on the bottom of a magazine received in the handgun or on a hand tool. The flashlight guide is adapted for resting on top of a portion of a flashlight for aligning a flashlight beam relative to a line of sight of the handgun or tool when pointing toward a target or work piece, so that the beam and line of sight intersect at a predetermined range.

(B) Discussion of Prior Art

In the United States, there are a number of manufacturers making flashlight systems having an adapter for permanently attaching a flashlight to a bottom of a grip of a handgun, a rifle, a shotgun and the like. The adapters provide light systems for firearms used by law enforcement, home security and sportsmen. Certain prior art flashlight adapters require special holsters for specific models of firearms.

A number of U.S. patents have issued which disclose light holders for firearms and the like. For example, U.S. Pat. No. 1,826,004 discloses a flashlight having a barrel rest between the light portion and the battery case. The barrel portion includes a setscrew and shims, but does not discuss their use in adjusting the orientation of the flashlight relative to the barrel.

U.S. Pat. No. 2,209,524 discloses a flashlight having a barrel rest that is adjustable vertically and horizontally, using a pair of setscrews. Optical means are disclosed for providing a light beam in which the central portion is rendered more visible.

U.S. Pat. No. 4,758,933 discloses handguns and shotguns including grooves to seat a cylindrical flashlight barrel by hand to aim in the same direction as the firearm.

U.S. Pat. No. 5,816,683 discloses a flashlight adapter which allows a flashlight to slide onto the bottom of the handle of a semiautomatic pisol. The flashlight and barrel axes are substantially parallel, but there appear to be no means for adjusting the angle of the light beam relative to the barrel.

U.S. Pat. No. 3,106,348 discloses a bracket system for detachably mounting a flashlight on a hand supported firearm (e.g., the handle of a revolver) so that the flashlight is supported beneath the firearm and substantially parallel to the axis of the barrel to illuminate an area toward which the firearm is pointed. No means for adjustment of the flashlight relative to the barrel axis are disclosed.

U.S. Pat. No. 4,697,226 discloses a light mount for firearms, particularly shotguns, to selectively place a beam of light at the approximate point of impact from the firearm.

The flashlight is shown as mounted atop the shotgun barrel with devices including a tubular housing, a spring housing and a base member. No means are apparently provided for adjustment of the light beam relative to the barrel. Remote switching means for the flashlight are disclosed.

U.S. Pat. No. 5,167,446 discloses a handgun grip accessory for attachment to the tubular casing of a flashlight to enable the user to hold the flashlight while at the same time aiming the attached handgun (using a two-handed grip) at an object illuminated by the flashlight. No means are apparently provided for adjusting the light beam relative to the handgun barrel. A finger-actuated switch for the flashlight is disclosed.

U.S. Pat. No. 5,560,703 discloses a mounting device for removably mounting a flashlight on a handgun, using a combination of brackets and an elastic band surrounding the handgun grip. The brackets are said to hold the flashlight in desired alignment with the barrel of the gun, but there is apparently no provision for adjustment of this alignment. The attachment system is said to avoid problems associated with the fitting of the handgun into a holster. Remote switching for the flashlight is disclosed.

U.S. Pat. No. 5,628,555 discloses a switch actuation mechanism for a firearm-mounted flashlight having a "momentary" switch mechanism. The actuating mechanism includes a lever to be actuated by the finger of the hand gripping the firearm to operate the flashlight. The flashlight is illustrated as attached to the magazine base of a semiautomatic pistol, but does not appear to be adjustable relative to the barrel.

U.S. Pat. No. 6,023,875 discloses an illumination source and mounting system to be detachably secured to a family of firearms including pistols, revolvers and long guns. A "mount-to-magazine interface" aligns the light beam to provide illumination at a fixed range impact point, but no adjustment of this alignment appears to be provided for. Remote pressure switching for the flashlight is disclosed. This system is commercially available as the "TACM III Tactical Light System" from Diamond Products Marketing, Inc. of Palm Bay, Fla.

U.S. Pat. No. 5,816,683 discloses a flashlight adapter for a handgun having a base retainer receivable into the interior of a magazine through the lower end thereof. Ther magazine base has a channel therein for receiving a lightholder holding a flashlight therein. A "QUIK-2-SEE" Flashlight Mounting System is commercially available, apparently related to this patent and connecting a flashlight to the magazine of a firearm in a fixed position via a flanged adapter attached to the flashlight and a T-rail sliding bar fastened to the magazine and adapted to interconnect with the flashlight flanged adapter.

Despite the numerous patents and products in this field, there remains a need for a simple, inexpensive, portable device or system which can be installed to fasten a light source to a projecting device such as a handgun to align the light beam substantially parallel with the weapon's line of sight in the horizontal plane and selectively aligned relative to the line of sight in the vertical axis so that the light beam and the line of sight intersect at the expected point of impact or point of aim.

None of the above mentioned prior art flashlight systems and adapters provide the unique structure, function, objects and advantages of the subject invention as described herein.

SUMMARY OF THE INVENTION

In view of the foregoing, it is a primary object of the invention to provide a light holder and guide attachable to a bottom of a grip of a handgun, a bottom of a firearm magazine or a hand tool and used for connection onto the top of a portion of a light source such as a flashlight. Another object is a guide which is adaptable for use on different sizes, shapes and lengths of flashlights. A further object is a guide which has no sharp or pointed parts that will bear against a user's hand, when inserting a magazine into the firearm or handling the unit.

Another object of the invention is to provide means for quick and accurate alignment of a flashlight beam relative to a line of sight of the handgun at a selected distance during night or low light engagement. A related object is aiming means wherein the proper alignment of the flashlight beam relative to the line of sight provides for better lighting of the sight picture on the firearm.

Yet another object of the invention is aiming means comprising at least one aiming wedge used with the guide for adjusting vertically the alignment of the flashlight beam relative to the weapon's line of sight to illuminate the target at a selected distance, usually the point of aim or expected point of impact.

Still another object of the invention is means by which the flashlight guide can be attached to the bottom of the grip of the firearm, the magazine or hand tool using different types of mechanical fasteners or glue.

A further object of the flashlight guide is the use of attachment means comprising a flashlight holder removably secured to the guide and adapted for encircling at least a portion of the flashlight. The object of the flashlight holder is to allow the user the free use of the hand which would normally hold the flashlight. Another object of the flashlight holder is a device which can also be used for attachment to the user's belt or securing to different types of storage devices or hangers.

In accordance with the present invention, a light guide assembly is provided for mounting on a projecting device, the light guide being used to align at least one light beam from a light source with a line of sight of the projecting device, the light guide assembly preferably being adapted for removable connection to the light source. The light guide comprises a guide base having an upper surface and a lower surface, with connecting means provided for connecting the upper surface to a lower portion of the projecting device. Connecting means are also preferably provided for removably connecting the lower surface of the guide base to the light source so that the light beam and the device's line of sight are substantially parallel. At least one aiming wedge having a predetermined included angle can be installed between the upper surface of the guide base and the lower portion of the projecting device to alter the alignment of the light beam relative to the line of sight of the device, normally in a vertical plane. In a preferred embodiment, a light guide comprises the guide base described above, with a first rail and a second rail extending downwardly and outwardly from opposite sides of the bottom surface of the guide base. Together, the inner surfaces of these rails and the bottom surface of the guide base lying between them form a space like an inverted "V" which will readily accomodate a cylindrical light source such as a flashlight in a stable position. The light source can be actuated by any suitable convenitonal switching, but preferably is connected to remote switching means adapted for actuating the source by the user while aiming the projecting device.

Further in accordance with a preferred embodiment the present invention, a flashlight guide assembly includes a guide base having an upper surface and a first and a second rail extending downwardly and outwardly from opposite sides of a bottom surface of the guide base. The first and second rails and the bottom surface of the guide base form an inverted V-shaped space which is adapted for rapid engagement of the top of a flashlight and along its length. The front ends of the rails, and front of the top surface of the guide base when mounted in a protruding position can serve as a finger rest extension for the little finger of the hand of the shooter when it is holding the flashlight and weapon. Also, the guide base can include one or more aiming wedges disposed between the upper surface of the guide base and the bottom of the handgun grip or magazine. The aiming wedges are used, singly or in combination, for adjusting vertically the alignment of the flashlight beam relative to the line of sight of the handgun so that these lines intersect at a selected distance.

Numerous advantages are attained by using the light guide assembly of the invention with firearms or other projecting devices. For example, in rapid, instinctive shooting situations, the invention permits rapid target identification and aiming. A distinct brighter central portion of the light beam (available with some flashlight models and bulbs; see, e.g., U.S. Pat. No. 2,209,524) can be used as a sight, previously zeroed to the firearm LOS. This can decrease the time needed for both target identification and aiming, which may be critical in exigent circumstances. Using the light guide assembly of the invention on a handgun, the weapon and light can be held (either separately or combined) close to the user's body below eye level, yet be ready for immediate firing. This provides a dual advantage of reducing fatigue during extended periods of searching in the dark and providing a desirable tactical position in the event of a close-quarters encounter with an opponent. Such a positioning method also allows better control of recoil for faster follow-up shots.

Due to its positioning and shape, the light guide assembly of the invention can facilitate speedy and effective replacement of magazines in pistols or other weapons. When a handgun is held in one hand and a magazine is inserted with the other, the magazine will often fail to seat properly if the inserting hand strikes the lower portion of the hand gripping the weapon. This problem has traditionally been solved by fastening extensions to the bottoms of magazines (called bumper pads or slam pads, commonly made of rubber) to provide the needed clearance. Such pads can also cushion the magazine base plate and spread the impact of insertion over a larger area to protect the base from damage, e.g. when an ejected magazine strikes the ground. Installation of the light guide assemblies of the invention accomplishes similar objects, and their exterior surfaces (which preferably slope outward) also provide an improved grasping surface, facilitating the removal of the magazine. (Magazines occasionally stick in the firearm, e.g. during a double feed stoppage. Sticking magazines are also common with polymer frame handguns.) Thus, the various light guides disclosed and claimed herein as being larger on the lower surface than on the upper surface (which is connected to the magazine) can be regarded as magazine grasping aids or gripping devices.

These and other objects and advantages of the present invention will become apparent to those familiar with various types of handgun accessories and flashlight attachments when reviewing the following detailed description, including the drawings, showing the contemplated novel construction, combination, and elements as herein described, and more particularly defined by the appended claims, it being understood that changes in the precise embodiments to the disclosed invention are meant to be included as coming within the scope of the claims, except insofar as they may be precluded by the prior art. Numerals are employed to identify corresponding or similar components in the figures and the description.

BRIEF DESCRIPTION OF THE DRAWINGS

The accompanying drawings illustrate preferred embodiments of the present invention according to the best modes presently devised for the practical application of the principles thereof, and in which.

DETAILED DESCRIPTION OF PREFERRED EMBODIMENTS

Figure 1:
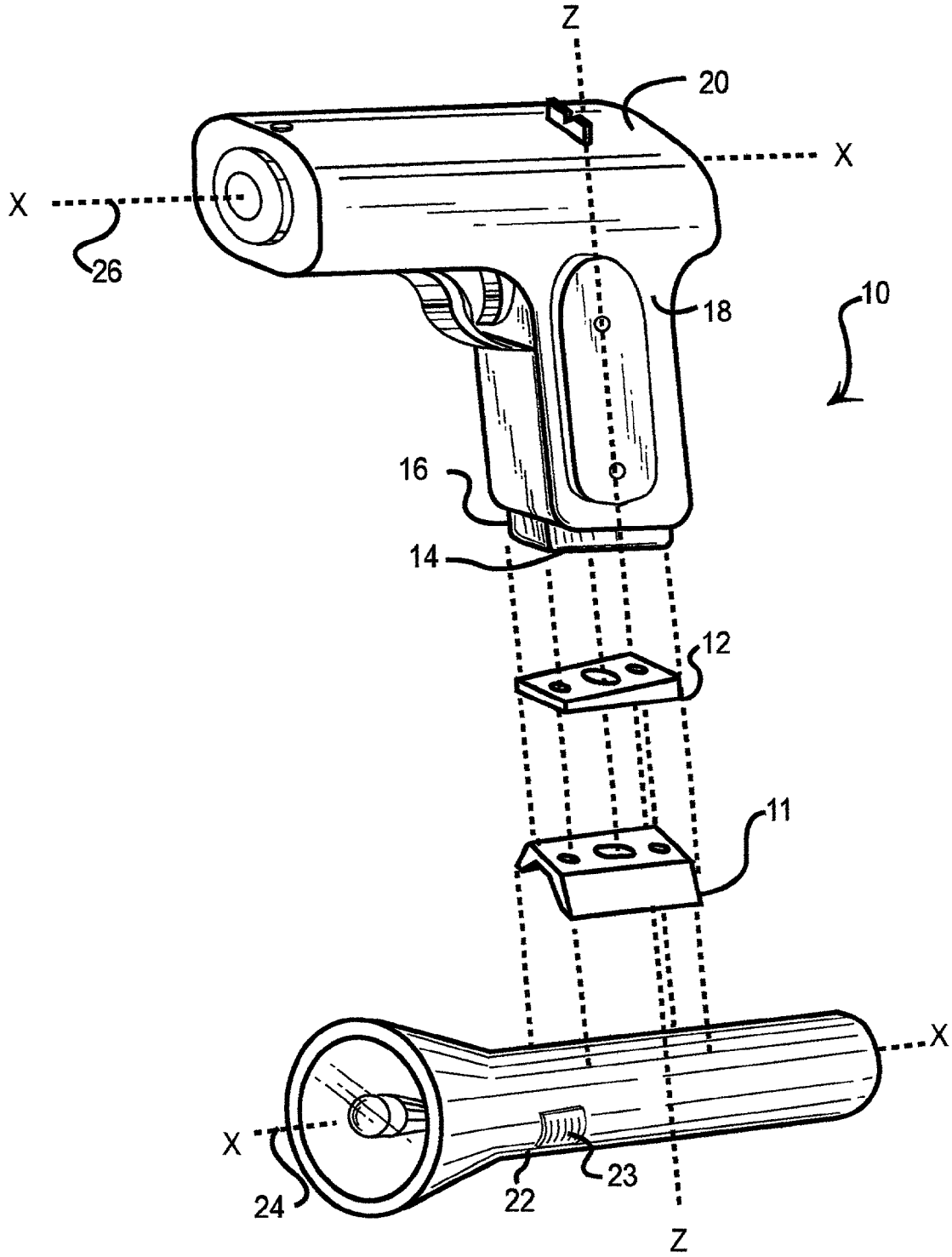
FIG. 1 is an exploded perspective view of the subject flashlight guide with a selected aiming wedge positioned for attachment to the bottom of a magazine received in the handgrip of a handgun. A flashlight is illustrated showing the flashlight guide positioned to be received and rest on a portion of the top of a length of the flashlight.

The light source guide systems of the present invention will be described as installed on a particular projecting device, namely a semiautomatic pistol containing a magazine in the handgrip. This illustration is intended to be exemplary rather than limiting of the invention. The light source can be a typical flashlight, normally battery-powered, providing a beam of visible light which can be focused into a relatively narrow beam. In particular embodiments, other power sources including household electricity or vehicle systems can be used, and alternative or additional portions of the electromagnetic spectrum (including the infrared and ultraviolet) can be employed. Multiple light sources can be used, such as a source with a relatively diffuse illumination beam and a laser or other device producing a narrow beam. Such multiple sources can be adapted for use simultaneously and/or separately, and can be arranged so that their beams are parallel or coincident.

By "projecting device" is meant a weapon or other device which aimably launches a projectile or other object some distance from a barrel or other longitudinally-aligned launching device. Conventional firearms with which the invention can be employed include pistols such as revolvers and semiautomatic models containing a magazine in the handgrip thereof, long-barreled guns such as rifles, shotguns and carbines; military or unconventional weapons including a pistol-like handgrip such as automatic pistols, submachine guns and firearms with shortened stocks, and the like. Firearms with long magazines protruding below the frame may require that the guide systems of the invention be attached to the magazine, barrel or stock to maintain a clear beam line to the target or expected point of impact. In addition to conventional small arms for military, sporting or law enforcement use, the guide assemblies of the invention can be employed with military weapons including hand-held or mounted grenade launchers, machine guns, and antitank weapons such as rocket-propelled grenade launchers.

Projecting devices other than firearms with which the guide assemblies of the invention can be used include crossbows, especially those with pistol grips, archery bows including sighting devices, paintball guns and similar training or recreational devices, squirt guns; gas, air or spring-powered pellet and BB guns; underwater spearguns and the like. Such projecting devices also include various types of dart guns, ranging from recreational devices to those used for tranquilizing large animals.

The guide assemblies of the present invention are not limited to use with projecting devices such as firearms, but can also be used to mount light sources upon any handtool or other device which would benefit from the presence of a light source which is aimable in at least one axis relative to the axis of the device. For example, the guide assemblies can be used to mount light sources upon hand tools such as rakes, hoes, forks or shovels to focus the light upon a point adjacent the working end of the tool to facilitate gardening at dusk, digging or gathering shellfish, or similar activities. They can also be used to provide illumination for pruning hooks, pole-mounted fruit picking devices and the like. Other uses include elongated devices used for spraying pesticides or emplacing traps or other devices for pest control in remote locations where visibility is limited. Sporting applications include hand-held harpoons, tridents and the like used for fishing, frogging or crabbing. The light guides can also be used with underwater spearguns and the like, provided that diving flashlights or the like are employed. Further applications include hand-held or mounted photographic or video equipment.

Although the systems of the invention are generally symmetric for mounting upon the projecting devices and illustrated and described for use of devices held primarily with the right hand, if necessary the devices can be altered for suitable mounting on asymmetric projecting devices and/or constructed for use with devices having left hand grips, generally by producing mirror images of the embodiments shown herein for right hand grips. Certain terminology will be used in the following description for convenience in reference only, and should not be considered limiting. The words "up", "down", "right" and "left" will designate directions in the drawings to which reference is made. The words "front" and "rear" will refer, respectively, to the muzzle and of a firearm and the opposite end therefrom. The words "top" and "bottom" will refer to the portions of the components of the invention and the projecting devices upon which they are employed which are shown as uppermost or lower in the drawings, and which are normally uppermost or lower when used in the normal terrestrial frame of reference in which the "top" or upper surface is the side opposite the gravitational force.

Turning now to the drawings, in FIG. 1, a perspective view of the subject flashlight guide assembly is shown having a general reference numeral 10. The flashlight guide assembly 10 can include one or more aiming wedges 12 used for flashlight beam alignment and means for attaching the light source. The light guide 11 and one of the aiming wedges 12 are shown positioned for attachment to a bottom 14 of a magazine 16 received in the handgrip 18 of a generic semiautomatic handgun 20. A flashlight 22 is shown positioned under the flashlight guide 11. The guide 11 is designed to be received in a resting position on top of a portion of a length of the flashlight 22 for aligning a flashlight beam, shown as dashed lines 24 in FIG. 2. Due to the form of guide 11, the flashlight can be held in a stable position by the shooter's left hand while shooting.

Figure 2:
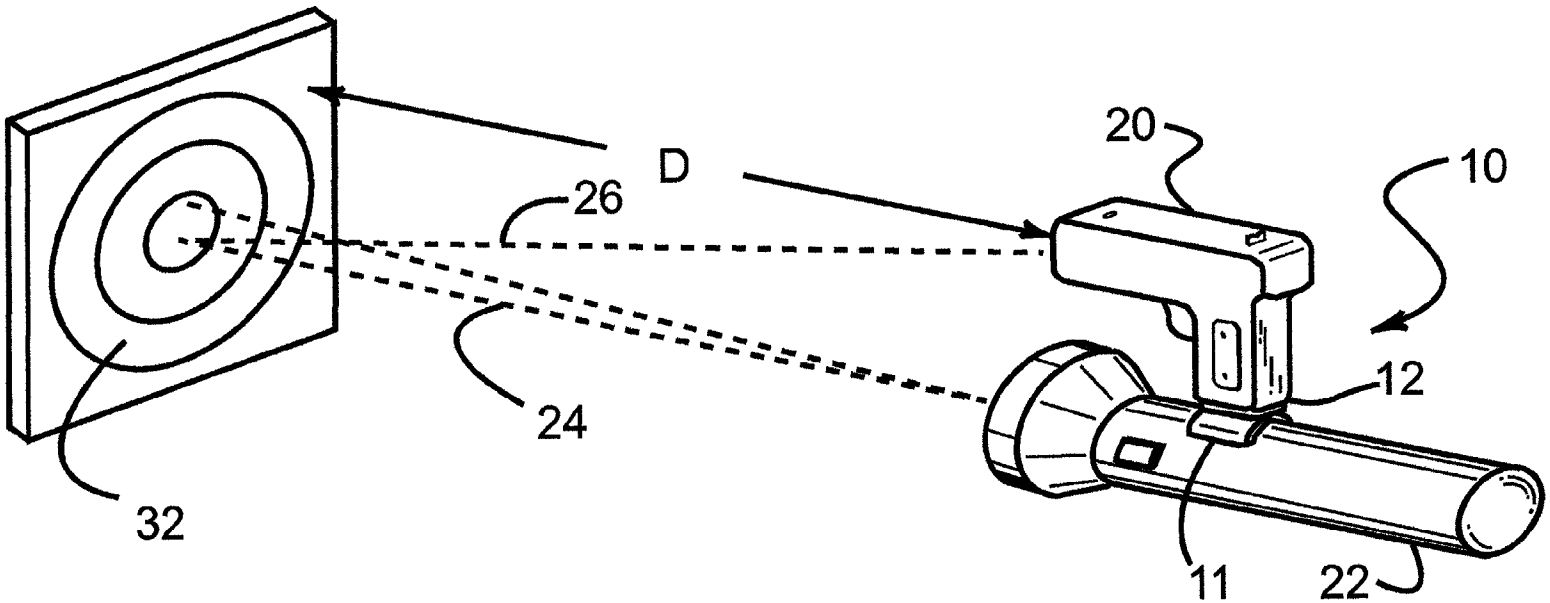
FIG. 2 is a perspective view showing a line of sight of the handgun and the flashlight beam intersecting at a selected distance "D" on a target.

It should be noted that using the flashlight guide 11, the length of the flashlight 22 and the flashlight beam 24 and a line of sight of the handgun 20, shown as dashed lines 26 in FIG. 2, are substantially aligned with each other in a vertical plane. The vertical plane is formed by a horizontal "X" axis and a substantially vertical "Z" axis as shown in FIG. 2. The "X" axis runs the length of the handgun 20 and along its line of sight (LOS) and runs parallel to the flashlight beam 24 and the length of the flashlight 22. The "Z" axis runs vertically along the length of the grip 18 and substantially parallel thereto. In this manner, the line of sight of the handgun and the flashlight beam are disposed in the same vertical plane for proper alignment using the subject invention. If desired, the guide 11 can provide a small angle between the beam and the LOS in this vertical plane. A lateral axis Y (not shown here) can be defined substantially perpendicular to the X and Y axes to provide a three-dimensional system. Small lateral adjustments to the beam direction can be made when installing the guide assembly to ensure that the beam and weapon line of sight are substantially parallel in the horizontal (X-Y) plane, by rotating the guide assembly laterally about the vertical axis of its attachment to the weapon base.

Since the guide assembly positions the light source some distance from the weapon's bore or line of sight, parallax will affect the alignment of the light beam and the weapon's line of sight at the short ranges normally used, while the beam and line of sight will approach parallelism at infinite range.

While the subject flashlight guide assembly 10 is shown and discussed in use with the handgun 20, it should be kept in mind that the guide can be used equally well with rifles, shotguns and other types of firearms and tools requiring the use of a flashlight when operating in the dark.

Figure 1A:
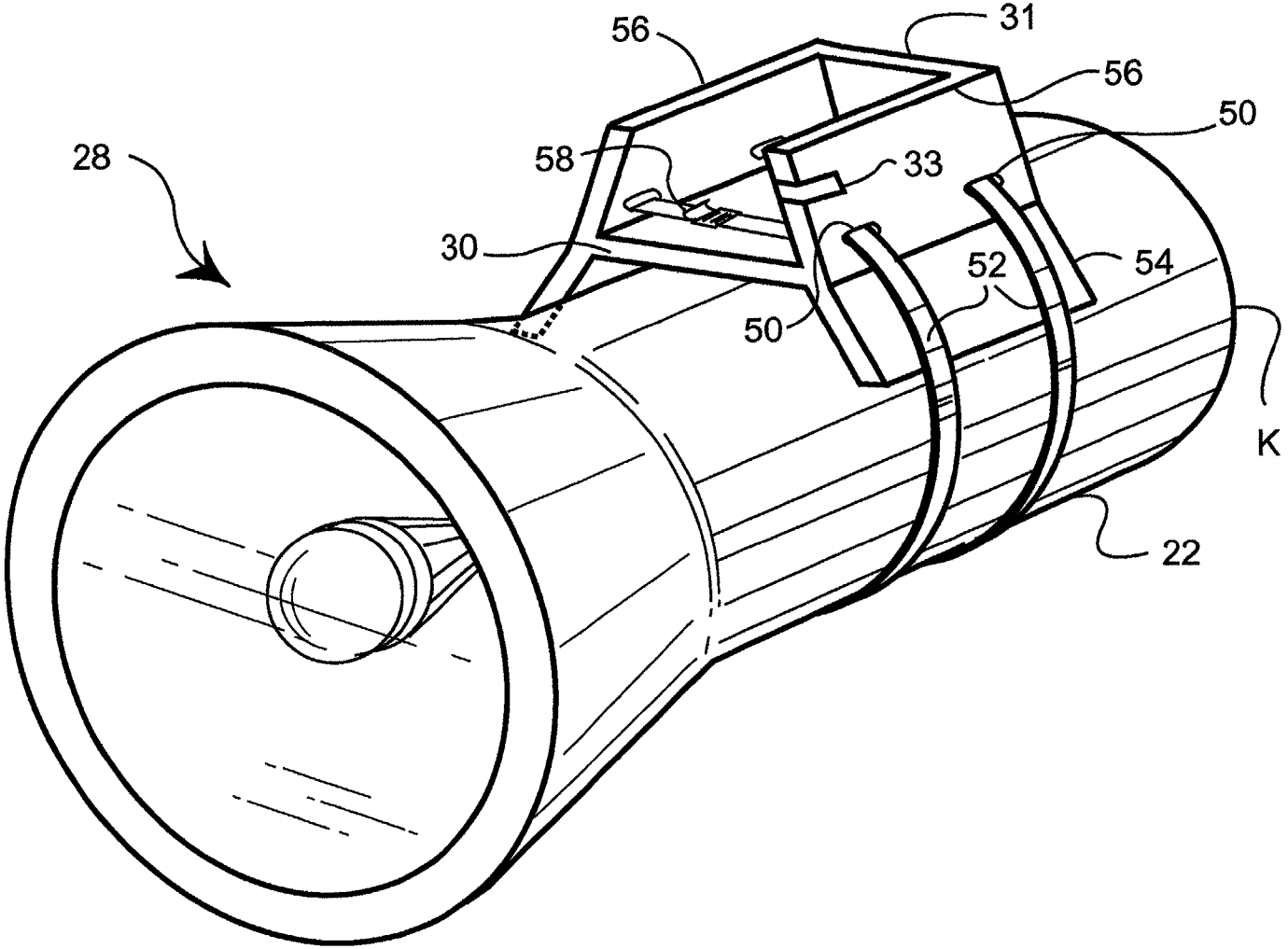
FIG. 1A is a perspective view of a flashlgiht holder attached to the flashlight guide for freeing a hand used in holding the flashlight.

In FIG. 1A, a perspective view of a flashlight holder 28 is shown for fastening to a portion of the flashlight 22 and attachment to the light guide. The flashlight holder is preferably adjustable to accommodate light sources of various sizes. A flashlight receiver section is formed on the lower portion of holder 28 by two rails 54, which will accomodate flashlights of various sizes much like light guide 11. Base 30 of holder 28 is connected to rails 54, both sides 56 and stop 31. Sides 56 each contain at least two lateral holes or slots 50 to accomodate strapping means 52 (nylon ties or straps, cord, wire or other suitable materials) to encircle flashlight 22 and secure it to holder 28. Securing means 58 are preferably provided for these strapping means. Light guide 11 (not shown here) can then be secured inside the upper engaging portion of holder 28 (comparable to the upper portion of the device shown in FIG. 1B) to attach the flashlight to the light guide and the handgun or other projecting device. The holder 28 can thus be attached to the bottom of the flashlight guide 11 for freeing a hand normally used in holding the flashlight apart from the handgun. Care should be taken in attaching flashlights or any light source to the handgun or other projecting device to position same to optimize the balance of the combined devices.

Any suitable switching means can be used for the light source, such as sliding switch 23 shown on the side of flashlight 22 or conventional pressure on-off switches placed in the base of the flashlight or other light source. When the flashlight is hand-held against the light guide during operation, it is convenient to use such switches directly. However, for tactical, convenience and marksmanship reasons, it is preferred that remote switching means be provided which can be actuated by a finger of the shooter operating as a momentary switch which actuates the light only when pressure is applied or in a conventional on-off mode. Such switches and installations on firearms are disclosed in U.S. Pat. Nos. 5,628,555; 4,697,226; 5,167,446; 5,560,703 and 6,013,875, all of which are incorporated herein by reference in their entirety, including the figures.

Figure 1B:
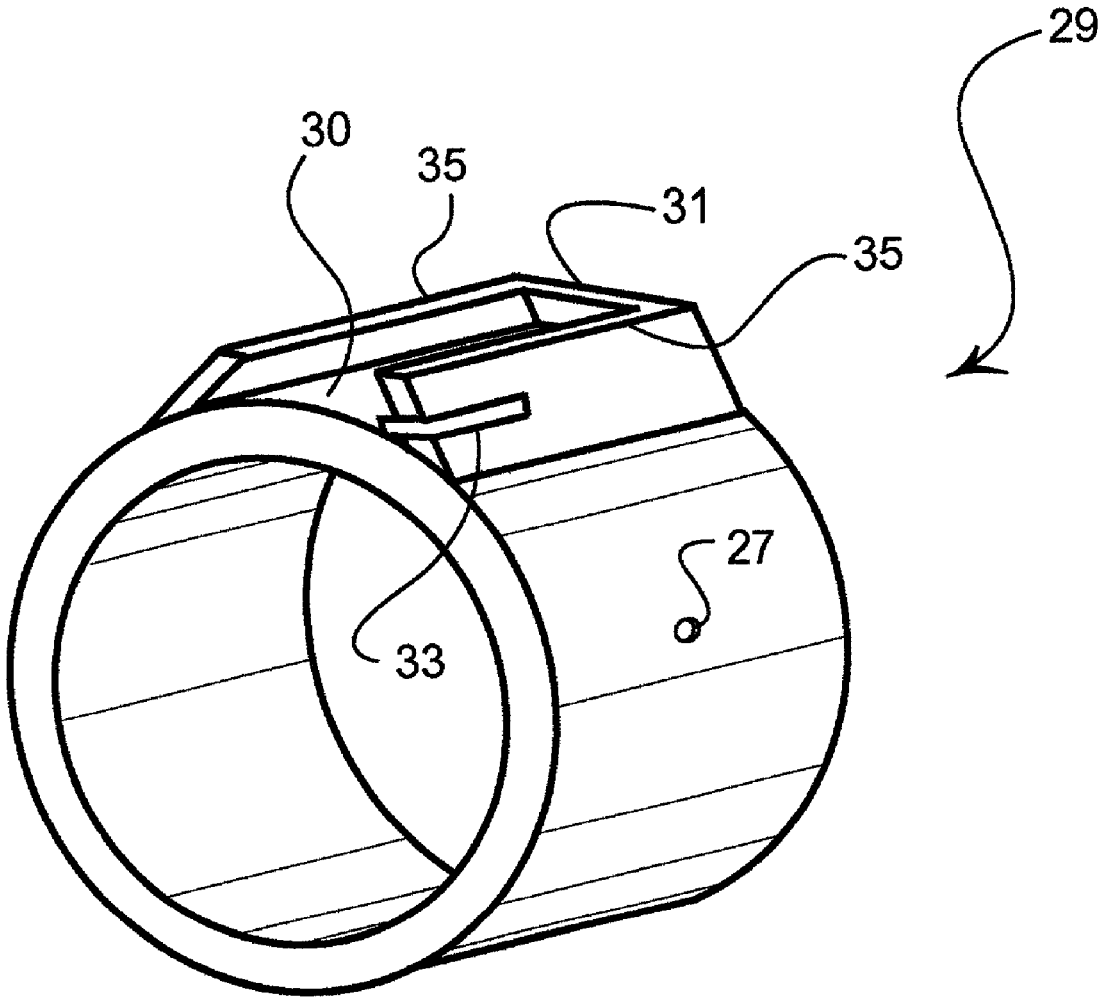
FIG. 1B is a perspective view of another device adapted for releasable attachment to the flashlight guide and fastening to a portion of the flashlight.

In FIG. 1B, a perspective view of another type of flashlight holder 29 is illustrated, having a contoured open top guide housing 30 with stop 31 for receiving the flashlight guide 11 therein (not shown here) in dovetail fashion. The guide 11 is held in the guide housing 30 using at least one spring catch 33, which is adapted to catch the front end of guide 11. When the spring catch 33 is moved outwardly, guide 11 can be slidably released from inside guide housing 30. A setscrew 27 or other threaded fastener can be used in guide housing 30 or elsewhere on holder 29 to secure a flashlight in place. Also, guide 11 can have a magnet incorporated into its structure or an attached magnet for securing the guide bracket to the top of the flashlight 22. If the case of flashlight 22 is not ferromagnetic, magnetic material can be attached thereto to facilitate such attachment to the guide bracket. Clearly, there can be any number of combinations and types of attachment devices and means used for holding the flashlight guide assembly 10 on the top of the flashlight 22. When attaching the light source (e.g., flashlilght) to the light guide, care should be taken to arrange the light source in any holder or attachment means so as to optimize the balance of the complete assembly.

Figure 1C:
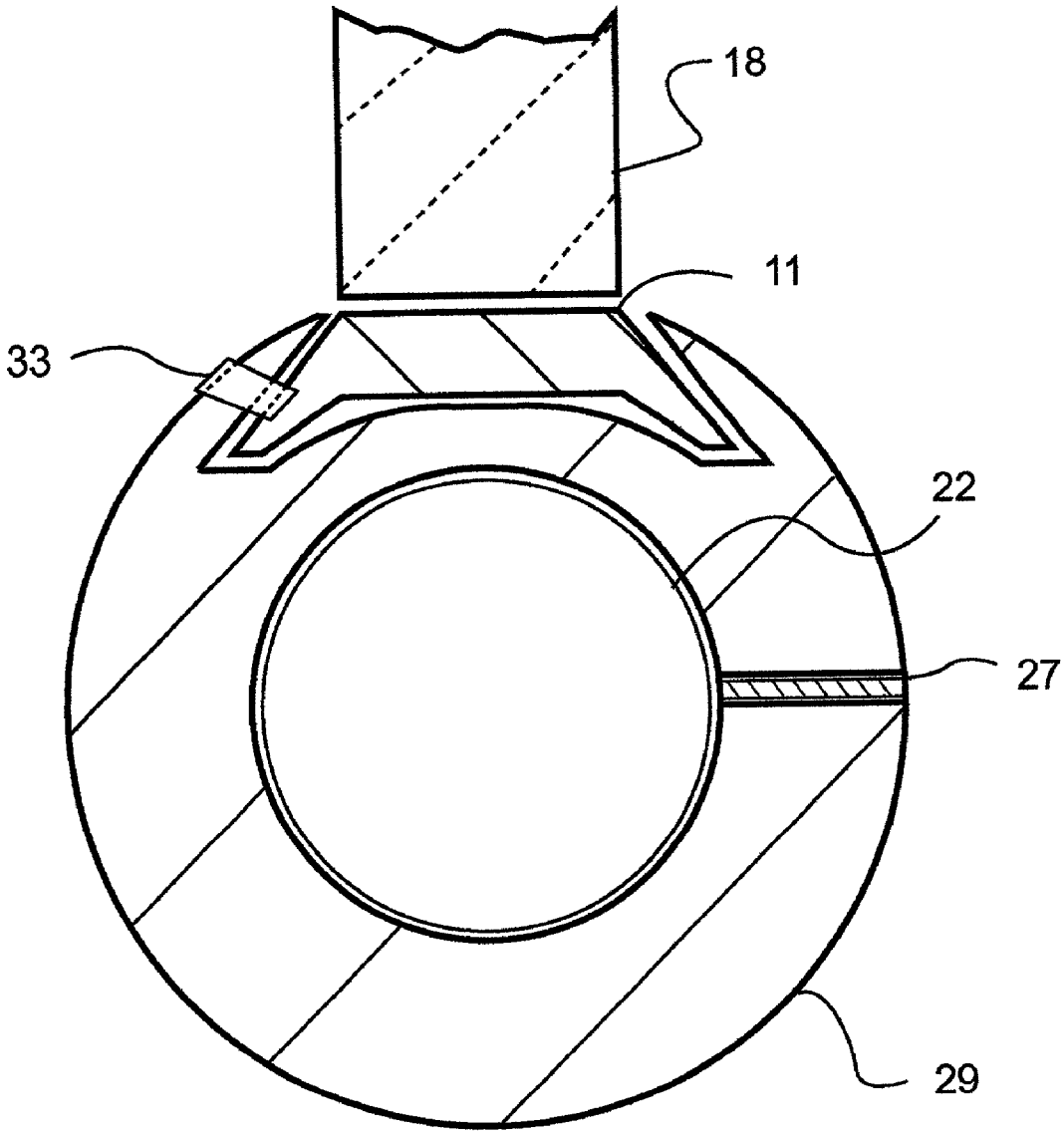
FIG. 1C is a sectional view of a flashlight holder similar to that of FIG. 1B, attached to a light guide and containing a flashlight.

FIG. 1C illustrates in cross section a flashlight holder 29 similar to that of FIG. 1B, containing a flashlight 22 which is retained in place with a setscrew 27 or similar fastener. The upper portion of the holder has been attached in dovetail fashion to the rails of light guide 11, which is attached to butt 18 of a handgun or the like. Holder 29 is retained in place as installed by clip 33, which can be easily attached or detached by the operator with one hand, and can further be used for carrying the holder (and flashlight, when installed) from a belt or other attachment point.

FIG. 2 is a perspective view in which the line of sight 26 of the handgun 20 and the flashlight beam 24 are shown aligned at a selected distance "D" on a target 32. The distance may be in the range of about 4 to 7 yards or greater, depending upon the type of weapon and the expected shooting environment. If one or more aiming wedges 12 are used, the flashlight beam 24 can be adjusted upwardly or downwardly in the XZ vertical plane for illuminating a point of impact on target 32.

Figure 3:
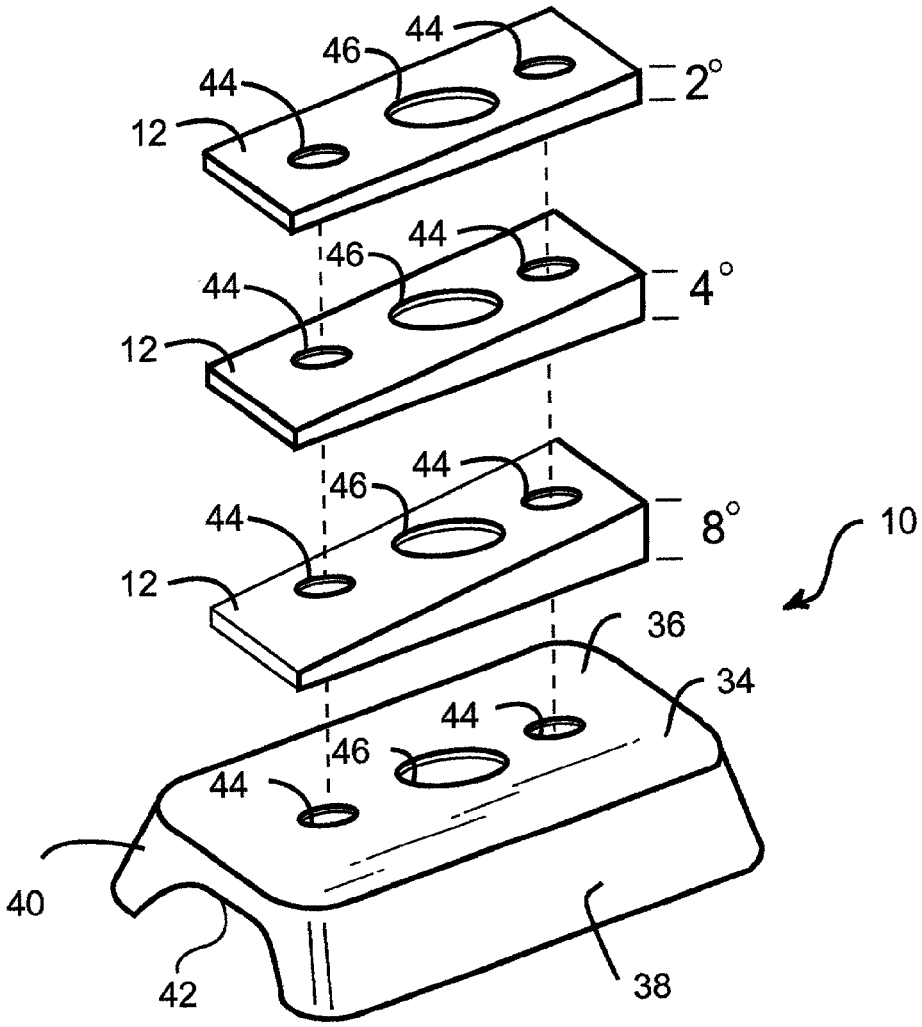
FIG. 3 is an enlarged, exploded perspective view of the flashlight guide and multiple aiming wedges having different degrees of angle from the horizontal and used in aligning the flashlight beam.

In FIG. 3, an enlarged, exploded perspective view of the flashlight guide 11 and aiming wedges 12 is shown. The wedges 12 can have different amounts of included angle, for example 2 degrees, 4 degrees or 8 degrees, and are used in aligning the flashlight beam. Two or more wedges can be coupled together for altering the angle of the flashlight beam 24 relative to the line of sight 26. The wedges can be "stacked," or combined with their tips pointing in the same or different directions, to achieve fine adjustments in the angle between the light beam and the line of sight. At short range, the light beam will normally be directed slightly above the LOS.

The flashlight guide 11 preferably includes a guide base 34 having an upper surface 36 and a first rail 38 and a symmetrically spaced apart second rail 40 extending downwardly and outwardly from opposite sides of the bottom surface 42 of the guide base 34. The first and second rails 38 and 40, with space therebetween and the bottom surface 42 of the guide base 34 are adapted and provide for rapid engagement on a portion of the top of the flashlight 22, regardless of the diameter of the flashlight, and provide proper lateral alignment of the flashlight beam 24 relative to the line of sight 26 of the handgun 20. While not shown in the drawings, the rails 38 and 40 can be constructed to be folded on the guide base 34 for convenient storage or carrying. The outer surfaces of rails 38 and 40 extend downwardly and outwardly for ease of handling, as discussed below.

Also, while not shown alone in the drawings, the bottom surface 42 can be flat across the width of the guide base 34 and used without the rails 38 and 40. In this embodiment of the guide 11, the flat bottom surface 42 of the guide base 34 is used to rapidly engage the top of a flat surface of a flashlight lantern or other light source using either manual pressure or suitable fastening means. However, even without rails 38 and 40, it is preferable that guide base 34 have some substantial thickness (say, at least about one inch) and a substantially trapezoidal or bulbuous form for units to be attached to firearm magazines. As discussed above, this can facilitate the removal of stuck magazines. Clearly the flashlight guide bracket 11 can be contoured for rapid engagement on various contours and configurations of light sources such as flashlights, laser units, lanterns and other lighting devices.

Furthermore, the guide base 34 can include one or more of the aiming wedges 12 disposed between the upper surface 36 of guide base 34 and the bottom of handgun grip 18 or magazine 16. The upper surface 36 and the wedges 12 can be glued to grip 18 or magazine 16 or they can preferably include at least two holes 44 for receiving suitable mechanical fasteners for attachment to the grip or magazine. Any suitable mechanical attachment means can be used here and elsewhere in the assembly, including fabric hook-and-loop fasteners. Also, the upper surface 36 and wedges 12 can optionally include a larger take-down access hole 46 for providing access to a magazine floor plate takedown latch or disassembly latch in the bottom of the magazine 16.

Figure 4:
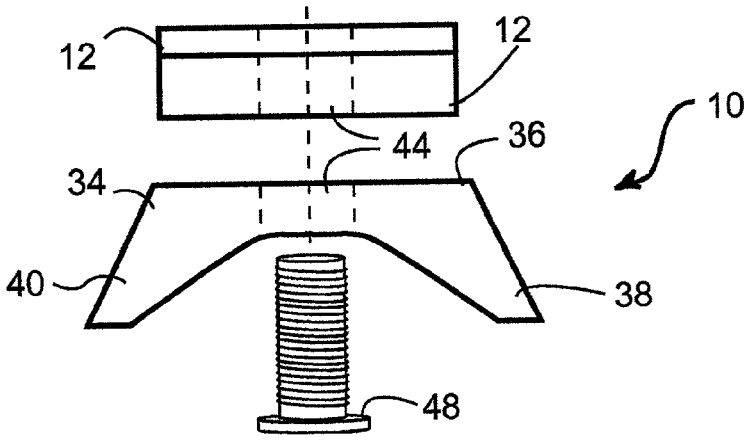
FIG. 4 is an end view of the flashlight guide with a pair of aiming wedges coupled together to increase the degree of angle from the horizontal used in aligning the flashlight beam.

In FIG. 4, an end view of the flashlight guide 11 is shown with a pair of aiming wedges 12 coupled together to increase the degree of angle relative to the LOS used in aligning the flashlight beam 24. Also, a threaded fastener 48 is shown for attaching guide bracket 11 and wedges 12 to the bottom of the pistol grip 18 or the bottom of the magazine 16 through holes 46 if fasteners are used rather than an adhesive. Wedges of different included angles can be assembled in combination, pointing in the same or different directions, to achieve the desired angle between the light source/beam and weapon line of sight.

INSTALLATION AND OPERATION

It is expected that those skilled in the art will appreciate the various means of installing and employing the devices of the present invention from the above detailed description. To further facilitate such actions, the following instructions are provided.

To install the light guide assembly on a firearm (for example, a semiautomatic handgun), first ensure that the firearm and magazine are unloaded. Determine the range for which the light beam is to be aligned relative to the LOS, and the desired illumination at the point of impact. (Depending upon the size and type of the expected target, the light may be directed to different areas, e.g. to blind the eyes of a live target.) Determine how the assembly is to be fastened to the firearm. One may use mounting screws alone (for magazine floor plate attachment), a fast-setting glue such as Loctite (R) Black Max(R) or both, for maximum strength. Note that gunsmith assistance may be required for installing screws or bolts in some weapons such as revolvers.

Before the light guide is installed on the grip base or magazine floor plate, hold the flashlight horizontally and place the light guide atop the flashlight, supporting the flashlight with one hand held below same. The firearm should then be pointed at a safe backstop with a distinct aiming point at a suitable range. (The traditional range for night engagements, for example, is 4 to 7 yards.) Holding the light guide bracket to the flashlight, hold the combined units to the butt (or magazine floor plate) of the handgun, keeping a firm, flat contact between the light guide and the handgun.

While aiming the gunsight at the target with the light guide, flashlight and handgun held together, turn the flashlight on (setting the beam for spotlight if available) and observe the vertical alignment of the light beam with the target. If the light beam is not aligned with the LOS as desired, place at least one aiming wedge between the handgun butt or floor plate to realign the light beam relative to the LOS. Check the position of the light beam again, and add, delete or reverse aiming wedges until the light beam strikes the desired portion of the target while the LOS is on the aiming point. (The beam can be directed to the aiming point or above, if desired.)

Once the combination of aiming wedges to be used is determined, the wedges can be glued to the light guide bracket and allowed to dry. Then the upper surface of the light guide assembly (including any wedges used) can be glued to the desired surface of the firearm. Before the glue sets, hold the flashlight and light guide assembly in position on the firearm while aiming at the target spot. Rotate the flashlight and light guide assembly in a vertical axis against this attachment point as needed to align the light beam horizontally with the target spot and gunsights. Ensure that the light guide bracket is evenly aligned with the handgun butt or magazine floor plate, and hold it in position until the glue sets. Then, remove the flashlight and place the firearm-guide assembly where this position will be undisturbed while the glue cures completely. At this point, holes may be marked and drilled for installation of any bolts or screws to be used. Note that if screws are used, they should be trimmed to avoid interference with the operation of the magazine parts.

For semiautomatic handguns, this procedure can be repeated for each magazine to be used with the light guide assembly, installing same for the same or different ranges. With other models of firearms, sporting implements or the like, the light guide assembly can be positioned and installed on any suitable attachment point.

Any suitable materials can be used to fabricate the components of the light guide assemblies described above. Metals of various types can be used, and can be finished or coated to complement the appearance of the firearm, minimize reflections, etc. Various polymeric compositions, including composites, can be used, and can have properties ranging from rigid to flexible to resilient. Care should be taken to avoid brittle materials, whether metallic or plastic. It is presently preferred to use a resilient polymeric composition to absorb some shock when a magazine on which the assembly is mounted is dropped onto the ground. This can also help in mounting the light guide bracket to a flashlight or other light source. Thermoplastic polymers suitable for injection molding are preferred. Commercially available materials include Nylon(R), Delron(R), polyvinyl chloride polymers and acylic-butadiene-styrene (ABS) polymers.

Although the invention has been described and illustrated in embodiments involving the use of the aiming wedges to align the light beam relative to the weapon's LOS in a vertical plane, in some cases the light guide assembly components can be installed on suitable portions of projecting weapons and other apparatus in different positions, for example rotated approximately 90 degrees. In such cases, the aiming wedges would be used to align the light beam relative to the LOS in a horizontal plane, and alignment in the vertical plane would be accomplished by rotating the light guide about a horizontal axis. For example, a light guide assembly and light source could be installed on one side of a shotgun fore-grip as well as below the grip or the same fore-grip. The components of the light guide assembly would still have essentially the same form, albeit adapted to a particular weapon model, and cooperate in the same manner.

While the invention has been particularly shown, described and illustrated in detail with reference to the preferred embodiments, it should be understood by those skilled in the art that the foregoing and other modifications are exemplary only, and that equivalent changes in form and detail may be made therein without departing from the true spirit and scope of the invention as claimed except as precluded by the prior art.

The embodiments of the invention for which an exclusive privilege and property right is claimed are defined as follows:

1. A light guide assembly for mounting on a projecting device, the light guide used to align at least one light beam from a light source with a line of sight of the projecting device, the light guide assembly being adapted for connection to said light source, and comprising:

a guide base having an upper surface and a lower surface;

connecting means adapted for connecting the upper surface of said guide base to a lower portion of said projecting device;

connecting means adapted for connecting the lower surface of said guide base to said light source so that said light beam and said line of sight are substantially parallel; and at least one aiming wedge adapted for installation between the upper surface of said guide base and said lower portion of said projecting device to alter the alignment of said light beam relative to said line of sight in a vertical plane.

2. The light guide assembly as described in claim 1 wherein said light source comprises a flashlight or flashlight lantern.

3. The light guide assembly as described in claim 2 wherein said guide base is solid and substantially trapezoidal or bulbuous in cross-section.

4. The light guide assembly as described in claim 1, further comprising a plurality of aiming wedges disposed one on top of the other and attached to the upper surface of said guide base to alter the alignment of said light beam.

5. The light guide assembly as described in claim 1, further comprising at least one hole in said guide base and said aiming wedge for receiving at least one mechanical fastener therethrough, said at least one mechanical fastener being used for securing said light guide to the bottom of said projecting device.

6. The light guide assembly as described in claim 1 wherein said projecting device is a firearm or other weapon having a handgrip to which said light guide assembly is attached.

7. The light guide assembly as described in claim 1 wherein said projecting device has a stock, external magazine or other fixture to which said light guide assembly is attached.

8. The light guide assembly as described in claim 1 wherein said guide base further comprises a first rail and a second rail extending downwardly and outwardly from opposite sides of said bottom surface of said guide base, and said first and second rail and said bottom surface of said guide base are adapted for rapid engagement on a portion of the top of said light source.

9. The light guide assembly as described in claim 8, wherein said light source comprises at least one of a flashlight or a laser.

10. The light guide assembly as described in claim 1 wherein said light source comprises remote switching means adapted for actuating said light source by a user while aiming said projecting device.

11. A flashlight guide assembly for mounting on a bottom of a grip of a handgun or the bottom of a magazine received inside the handgun grip, the flashlight guide used to adjustably align a light beam from a flashlight with the line of sight of said handgun, the flashlight guide being adapted for connection to a portion of the top of said flashlight, said flashlight guide assembly comprising:

a guide base having an upper surface and a bottom surface, said upper surface being adapted for mechanical connection to said grip or magazine;

a first rail and a second rail extending downwardly and outwardly from opposite sides of said bottom surface of said guide base, wherein said first and second rails with a space therebetween and said bottom surface of said guide base are adapted for resting on and rapid engagement with a portion of the top of said flashlight; and at least one aiming wedge, said aiming wedge received on top of the upper surface of said guide base and attached thereto to alter the alignment of said light beam relative to said line of sight in a vertical plane.

12. The flashlight guide assembly as described in claim 11, further comprising a plurality of said aiming wedges disposed one on top of the other and attached to the upper surface of said guide base.

13. The flashlight guide assembly as described in claim 11, further comprising at least one hole in said guide base and said aiming wedge(s) for receiving a mechanical fastener therethrough, said fastener used for securing the flashlight guide to the bottom of the grip of the handgun or the bottom of the magazine.

14. The flashlight guide as described in claim 11, further including attachment means secured to said bottom surface of said guide base, said attachment means being adapted for connection to a portion of said flashlight for holding the flashlight guide thereon and comprising a flashlight holder adapted for encircling at least a portion of said flashlight and for engaging with said flashlight guide in dovetail fashion.

15. The flashlight guide assembly as described in claim 13 wherein said attachment means comprises an open top flashlight holder comprising a stop for slidably receiving said first and second rails and the bottom surface of said guide base therein in dovetail fashion and is also adapted for encircling at least a portion of said flashlight.

16. A flashlight guide assembly mounted below a grip of a firearm, hand tool or other handheld item used in conjunction with a flashlight or flashlight lantern to align a flashlight beam from said flashlight with a line of sight of said handheld item comprising:

a guide base having a upper surface, a bottom surface and two diverging side surfaces extending below said grip, defining an axis having a fixed relationship with the line of sight, open to rapidly receive and align a portion of the flashlight with said firearm, tool or handheld item line of sight, said bottom surface being arranged to engage a top portion of said flashlight.

17. The flashlight guide assembly as described in claim 16, further including at least one aiming wedge received on the upper surface of said guide base and attached thereto.

18. The flashlight guide assembly as described in claim 17, further including a plurality of aiming wedges disposed one on top of the other and attached to the upper surface of said guide base.

19. The flashlight guide assembly as described in claim 18, further including at least one hole in said guide base and said aiming wedge(s) for receiving a threaded fastener therethrough, said fastener used for securing the flashlight guide to said hand held item.

20. A flashlight guide assembly mounted below a grin of a firearm, hand tool or other handheld item used in conjunction with a flashlight or flashlight lantern to align a flashlight beam from said flashlight with a line of sight of said handheld item comprising:

a guide base having a upper surface, a bottom surface, and a first rail and a second rail extending downwardly and outwardly below said grip from opposite sides of said bottom surface of said guide base to form a flashlight guide, said guide base defining an axis having a fixed relationship with the line of sight, open to rapidly receive and align a portion of the flashlight with said firearm, tool or handheld item line of sight, and wherein said first and second rails and said bottom surface of said guide base are adapted for rapid engagement with the top of a flashlight holder fitted on a flashlight, said flashlight guide and said flashlight holder engaging in dovetail fashion.

21. A flashlight guide assembly for mounting on a magazine of a handgun comprising:

a guide base having an upper surface which connects to a the bottom of a magazine inserted into said handgun, and first and second diverging lateral surfaces extending below said magazine open to receive a flashlight, and which define a pointing axis for the flashlight, said guide base being connected to said magazine to establish a relationship between said flashlight pointing axis and said handgun pointing axis, said guide base being arranged to engage a top portion of said flashlight.

22. The flashlight guide assembly according to claim 21 wherein said guide base is connected to said magazine through a means to adjust the pointing axis of said flashlight in at least one plane.

* * * * *